US005199530A

United States Patent [19]

Bialy

[11] Patent Number: 5,199,530

[45] Date of Patent: Apr. 6, 1993

[54] RETAINER ASSEMBLY

[75] Inventor: Louis Bialy, Simsbury, Conn.

[73] Assignee: Otis Elevator Company, Farmington, Conn.

[21] Appl. No.: 771,025

[22] Filed: Oct. 1, 1991

[51] Int. Cl.[5] ..... B66B 9/00

[52] U.S. Cl. ..... 187/1 R; 52/30; 52/584

[58] Field of Search ..... 187/1 R; 52/30, 227, 52/228, 79.9, 582, 584

[56] References Cited

U.S. PATENT DOCUMENTS 3,585,771 6/1971 Pinniger ..... 52/584
4,708,222 11/1987 Bills et al. ..... 187/1 R
5,048,243 9/1991 Ward ..... 52/584

*Primary Examiner*—Robert P. Olszewski
*Assistant Examiner*—Kenneth Noland
*Attorney, Agent, or Firm*—William W. Jones; Richard D. Getz

[57] ABSTRACT

A retainer assembly is provided having a clasp section and at least one collar. The clasp section has an axially extending aperture and cutout section. The cutout section, which exposes the aperture, allows the member of a stiffening assembly to pass through to and be received by the aperture. Once received by the aperture, the member is fixed within the aperture of the clasp section by the collar.

12 Claims, 5 Drawing Sheets

RETAINER ASSEMBLY

DESCRIPTION

1. Technical Field

This invention relates to elevators and more particularly to a retainer assembly for an elevator cab.

2. Background Art

In elevator systems, passengers ride in an elevator car suspended within the hoistway of the elevator. The elevator car includes a cab section and a platform. The cab section rests atop the platform, to which lifting equipment is typically attached. The lifting equipment, which lowers and raises the car within the hoistway, may consist of sheaves, cables, and drives or alternatively a hydraulically powered arrangement.

Typically, the cab sections are relatively heavy structures having a skeletal structure and wall panels. Some elevators, however, employ lightweight cabs which eliminate the need for skeletal structures. The strength of the light weight cabs lies in the design of the wall panels and the method of attachment between the panels. Despite the self-supporting characteristics of the wall panels, lightweight cabs sometimes require stiffening assemblies to add rigidity to the structure. Conventional stiffening assemblies may comprise rods which must be threaded to lugs attached to the wall panels of the elevator. Threading rods into lugs as a means for attaching the stiffening assembly to the car and tensioning the assembly, can be a time consuming practice.

DISCLOSURE OF THE INVENTION

It is an object of the present invention to provide a retaining means for an elevator cab stiffening assembly which facilitates attachment of the stiffening assembly to the cab.

It is a further object of the present invention to provide a retaining means for an elevator cab stiffening assembly which minimizes construction costs.

According to the present invention, a retainer assembly is provided having a clasp section and at least one collar. The clasp section has an axially extending aperture and cutout section. The cutout section, which exposes the aperture, allows the member of a stiffening assembly to pass through to and be received by the aperture. Once received by the aperture, the member is fixed within the aperture of the clasp section by the collar.

According further to the present invention, a means is provided for securing the collar to the clasp section of the retainer assembly.

According still further to the present invention, a means is provided for attaching the clasp section and collar to the elevator cab.

An advantage of the present invention is the ease in which the present invention permits a member to be attached to the wall structure of an elevator cab. Once the member is received by the aperture of the clasp section, the member is held in place by a collar which communicates with the clasp section of the retainer.

A further advantage of the present invention is the minimum number of required parts the present invention uses. Minimizing the number of required parts helps lower the cost of procuring and stocking parts for both initial assembly and for later replacement if necessary.

These and other objects, features, and advantages of the present invention will become more apparent in light of the detailed description of the best mode embodiment thereof, as illustrated in the accompanying drawings.

BRIEF DESCRIPTION OF THE DRAWINGS

FIG. 3 shows the top view of the folded cab as well as the phantom outline of the cab unfolded.

FIG. 4 shows the flange molded within the panel section and FIG. 4A shows an independent flange attached to a panel section.

BEST MODE FOR CARRYING OUT THE INVENTION

Figure 1:
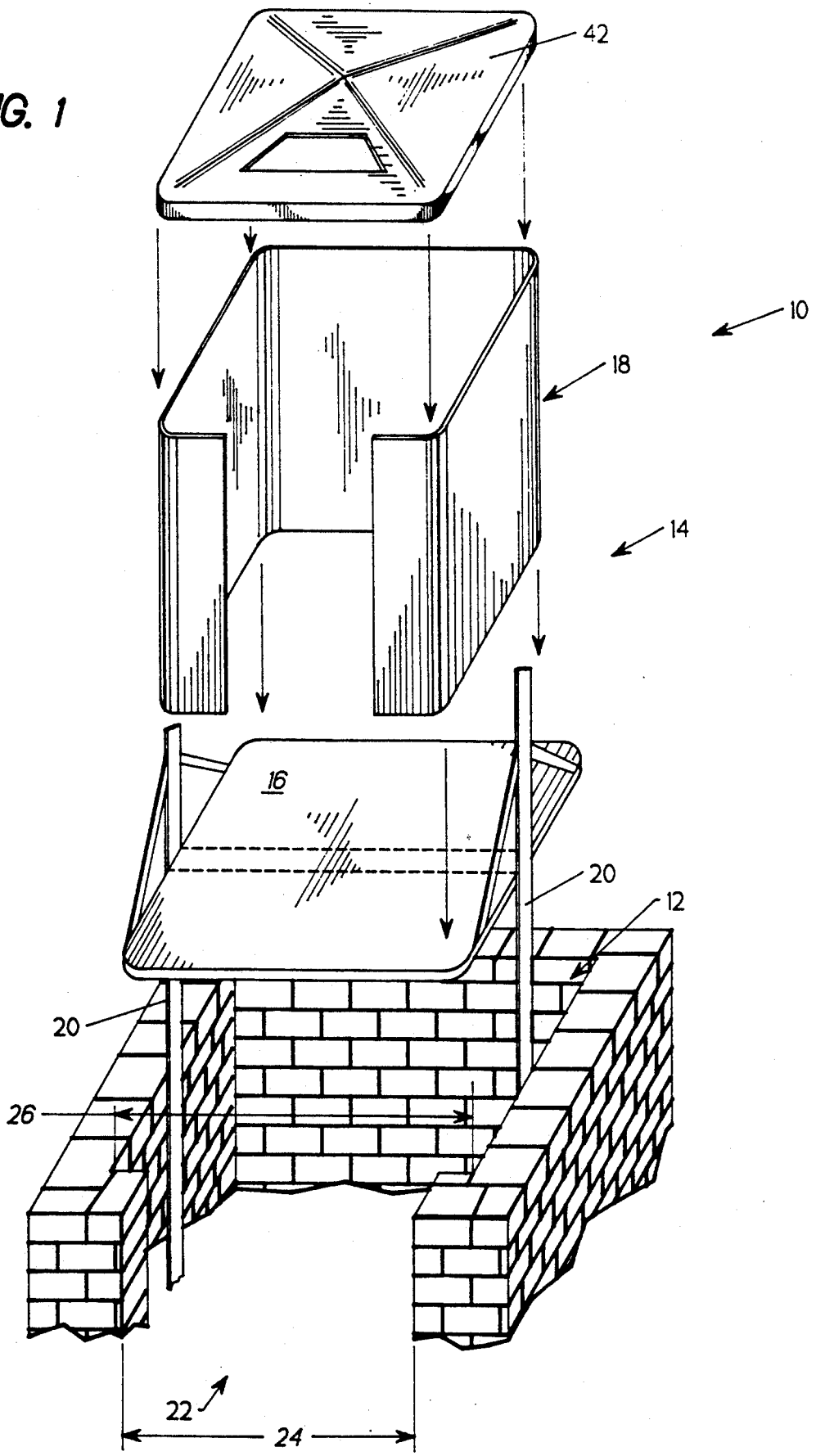
FIG. 1 shows an exploded view of an elevator car, having a cab and a platform, positioned within a hoistway of an elevator.

Now referring to FIG. 1, an elevator 10 comprises a hoistway 12 and an elevator car 14. The elevator car includes a platform 16 and an attached cab 18 which travel along rails 20 located within the hoistway. The hoistway typically includes door openings 22 positioned at each floor of the building (not shown). The width 24 of the door opening 22 is less than the width 26 of the hoistway.

Figure 2:
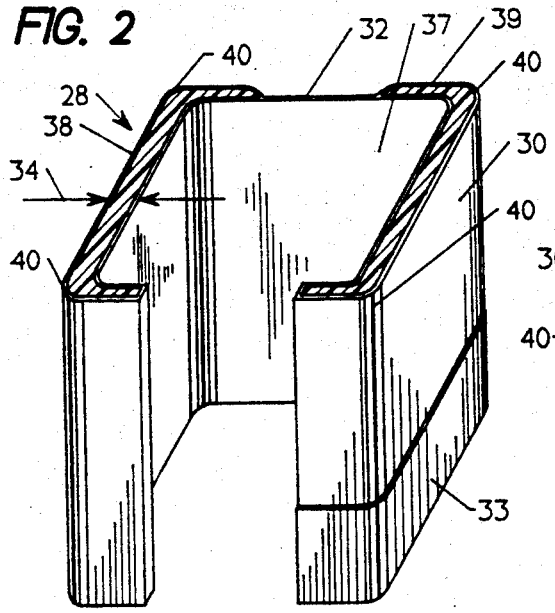
FIGS. 2, 2A, and 2B shows the elevator cab of FIG. 1.
Figure 2A:
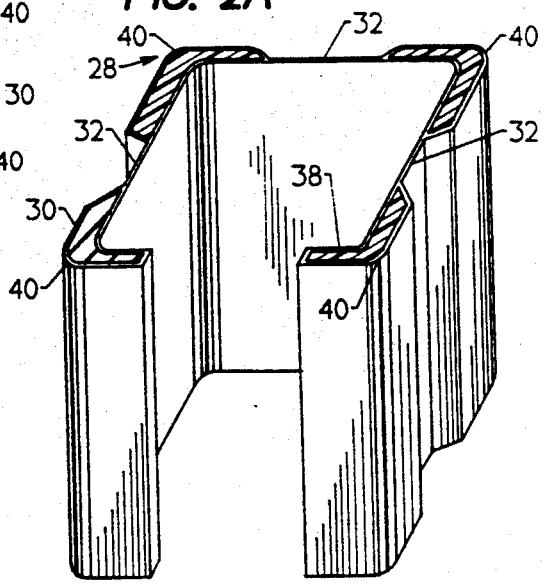
Figure 2B:
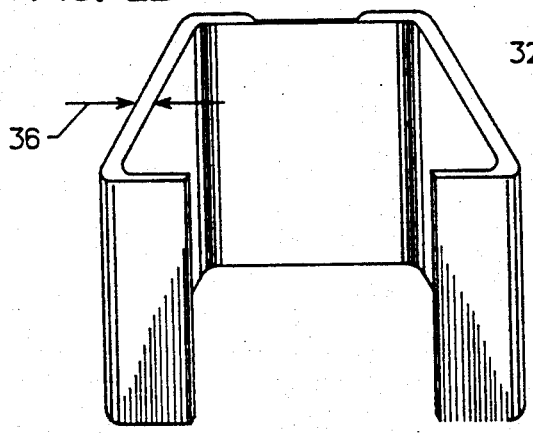

Now referring to FIG. 2, 2A and 2B, the elevator cab 18 is constructed from a plastic or composite wall structure 28 that includes a plurality of panel sections 30 and at least one integrally attached flexible hinge seam 32 capable of being elastically deformed. The wall structure has a multi-layer cross-section 34 which is formed by either blow-molding, injection-molding, or otherwise forming a plastic such as polyurethane, polyethylene, or polyvinyl chloride (PVC). The wall structure material may alternatively be a composite, for example the aforementioned plastics may be integrally combined with fibers or a mesh substrate for added strength. In a second embodiment, the wall structure may have a single layer cross-section 36, and may be formed from either the aforementioned plastics or composites. Either the single-layer or the multi-layer configuration may also include a metal panel 33 attached to the exterior surface of the wall structure 28 for fire prevention purposes.

In the preferred embodiment, the panel sections 30 of the wall structure 28 contain a filler material 38 such as foam to improve the acoustic, heat transfer, and/or flame retardant properties of the wall structure. Other embodiments may employ different filler materials such as plastic, carbon fiber, or styrofoam depending on the requirements of the application. The inner 37 and outer 39 layers of the wall structure material hold the filler material within the panel sections. The wall structure material also forms the integrally attached hinge seam(s) 32. Other embodiments may not include the filler material within the cross-section of the wall structure.

The corner sections 40 of the wall structure 28 serve as rigid columns capable of bearing the load of a cab roof 42 (FIG. 1) and whatever additional weight safety standards dictate as necessary. A single hinge seam 32 separates two rigid panel sections 30, thereby permitting the wall structure 28 to be folded to a configuration of minimal dimensions. Alternatively, the panel sections may serve as columns and bear the load applied to the cab 18. Accordingly, more than one hinge seam may be employed to facilitate the folding.

Figure 3:
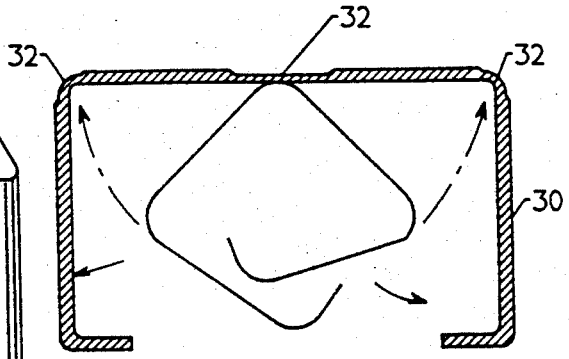
FIGS. 3, 3A and 3B show the elevator cab of FIG. 1 folded.
Figure 3A:
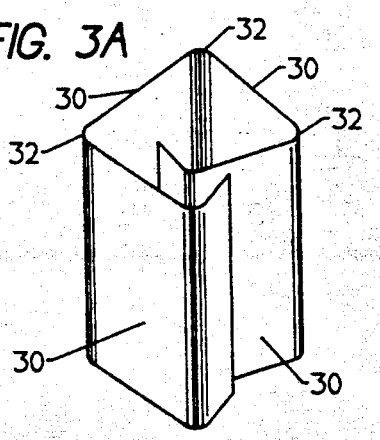
Figure 3B:
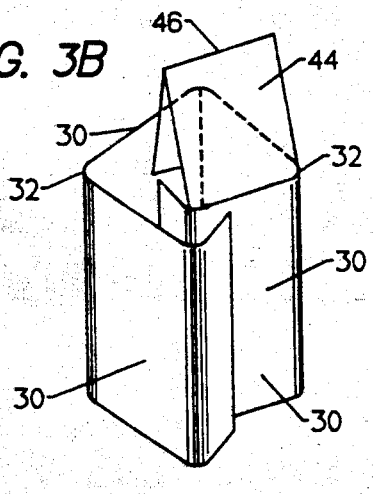

FIG. 3, 3A and 3B illustrate the method of folding one embodiment of the wall structure 28, consisting of two panel sections 30 and one elastically bendable hinge seam 32. Folding or bending the wall structure about the hinge seam(s) in the method shown allows the entire structure to be passed through the limited width 24 of the elevator door opening 22 and into the hoistway 12. Once the structure is within the hoistway, the structure can be unfolded and readily attached to the platform 16. Installing the structure as an assembled unit allows the peripheral hardware (not shown) to be attached prior to installation at a more economical time. Other configurations comprising more than two panel sections and more than one hinge seam may also be employed. In addition, a roof 44 with a second hinge seam(s) 46 may also be attached to a panel section of the wall structure. After installation of the wall structure within the hoistway, the roof may be further attached to the wall structure by conventional means, for example by nuts and bolts.

Figure 4:
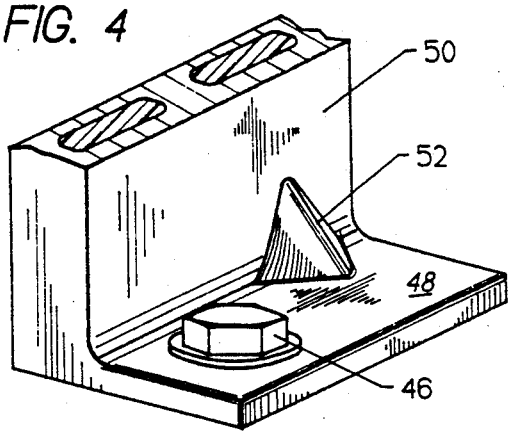
FIGS. 4 and 4A show a flange attached to the base of a panel section of FIG. 2.
Figure 4A:
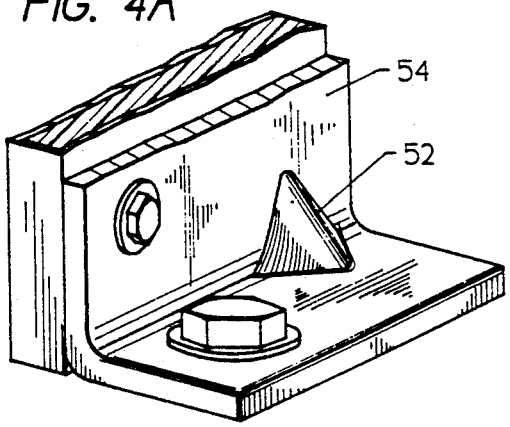

Now referring to FIG. 4 and 4A, once the wall structure 28 has been positioned on the platform 16 within the hoistway 12, it can be secured to the platform by bolts 46, for example. In the preferred embodiment, the bolts pass through a flange 48 integrally molded within the panel sections 30, which extends out from the external surface 50 of the panel sections. The preferred embodiment further includes webbing 52 attached to the flange, spaced at regular intervals, for added strength. In other embodiments, the flange may be a separate device 54 either fastened to (FIG. 4A) or molded within (not shown) the panel sections.

Figure 5:
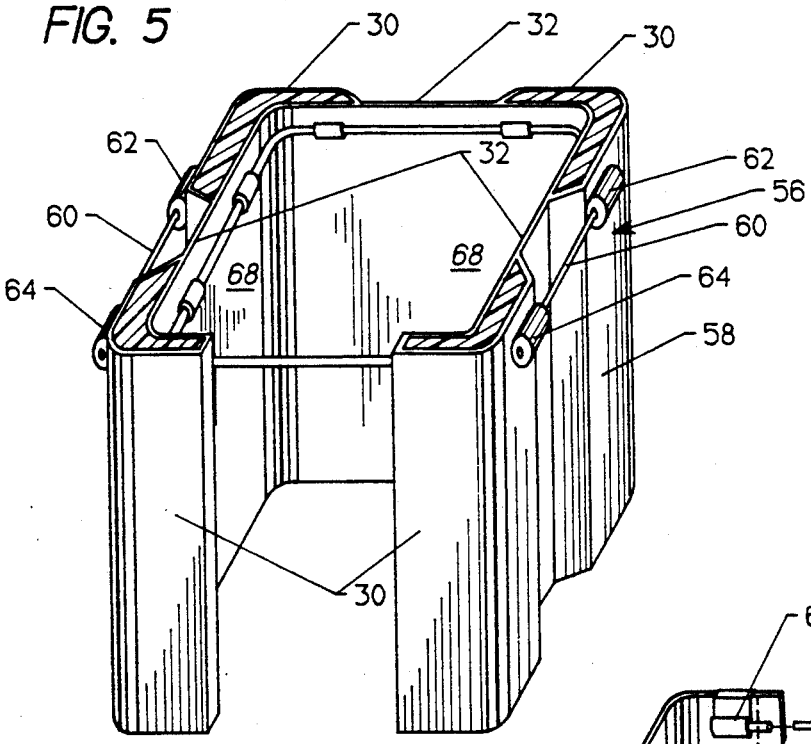
FIG. 5 shows a stiffening assembly attached to the exterior of the wall structure of FIG. 2 as well as a stiffening assembly having a continuous member and lugs attached to the interior walls of the wall structure.
Figure 5A:
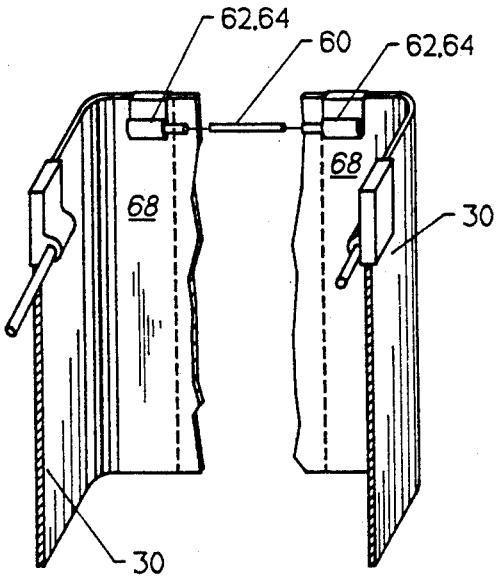
FIG. 5A shows a diagrammatic view of a stiffening assembly attached to the interior walls of a wall structure.

Now referring to FIGS. 5 & 5A, one or more stiffening assemblies 56 may be attached to the external surface 58 of the wall structure 28. Each stiffening assembly includes a threaded member 60 and a pair of threaded lugs 62,64 which receive the threaded member. The threaded lugs are molded into the panel sections 30 of the wall structure, one on each side of the hinge seam 32. Alternatively, the lugs may simply be fastened to the panel sections by conventional means. In another embodiment, one or more stiffening assemblies are employed which do not thread together, but can be tensioned by separate means, for example by nuts independent of the lugs, or a turnbuckle, or a cam design. Once the stiffening assembly(s) is installed, tensioning the assembly adds rigidity to the wall structure. The number of stiffening assemblies required depends on factors such as the number of hinge seams, the configuration of the cab, and the rigidity sought. In a further embodiment, a stiffening assembly comprising lugs and a continuous member 66, which extends around either the inner or outer perimeter of the wall structure, may be used.

Figure 6:
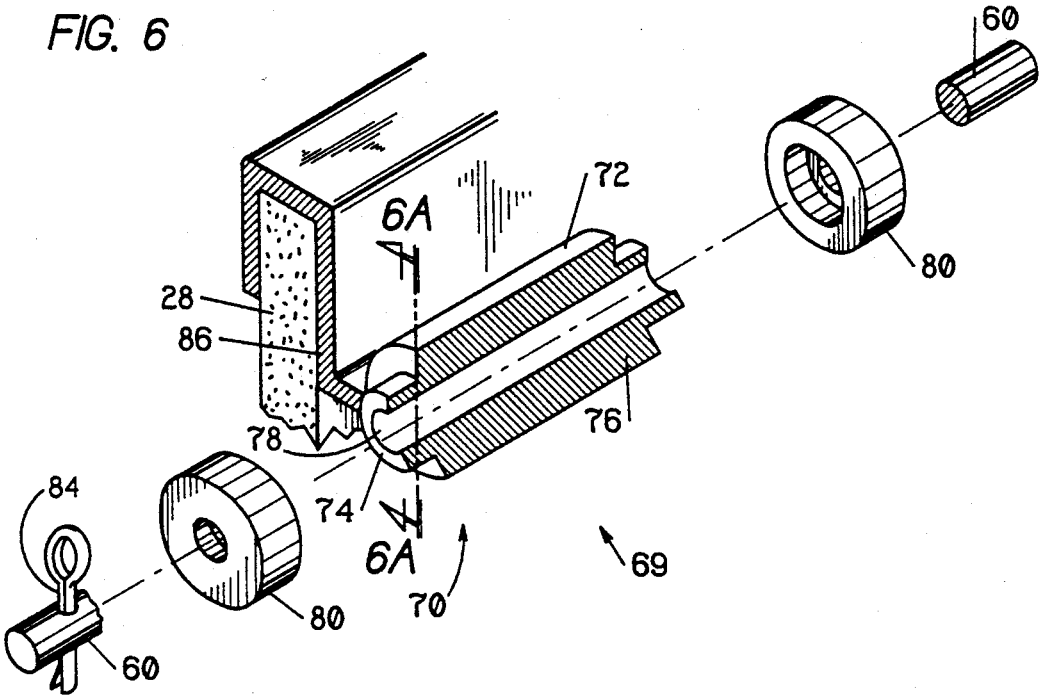
FIG. 6 shows a perspective view of a retainer assembly with bosses extending out from the main body of the retainer assembly.
Figure 6A:
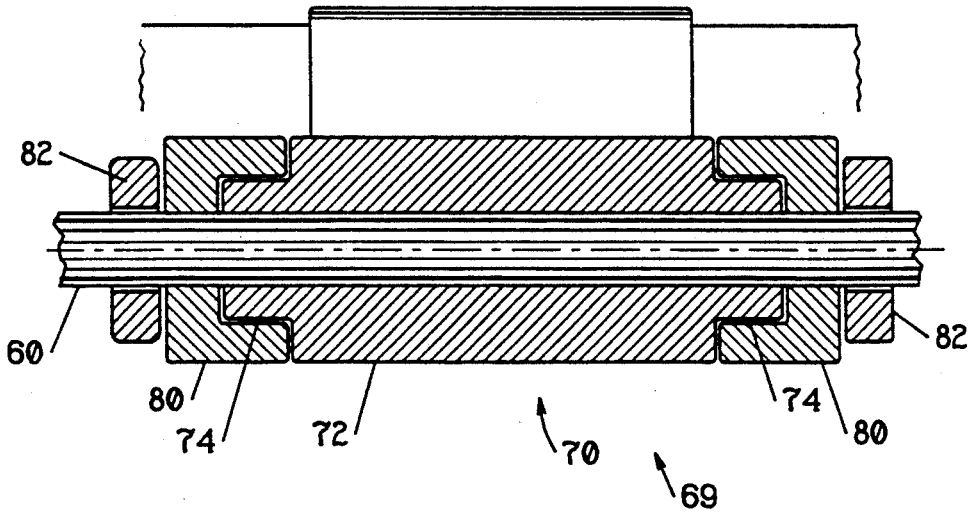
FIG. 6A shows a sectional view of the retainer assembly shown in FIG. 6.

Now referring to FIGS. 6 and 6A, in one embodiment, the aforementioned lugs 62,64 of the stiffening assembly 56 may be replaced by retainer assemblies 69. The retainer assemblies include a clasp section 70, disposed along an axis, with an axially extending aperture 78, the geometry of which compliments the cross-sectional geometry of the member. For example, if the member were a cylindrical rod, the aperture would be a bore large enough to create a slide fit with the rod. The clasp section has a main body 72 with a boss 74 extending out from each end, parallel to the axis of the clasp section. Alternatively, the bosses may be tapered. A cutout 76 extends axially along the entire clasp section 70, thereby exposing the center aperture 78 and allowing the member to pass through to and be received by the center aperture. A person skilled in the art will recognize that the cutout may assume a variety of different geometries.

Once the rod or member 60 is received within the center aperture 78 of the clasp section 70, retaining collars 80, also with an aperture, are moved axially along the member, over the bosses 74, until contact is made with the main body 72. The collars thereby fix the member within the clasp section.

Figure 7:
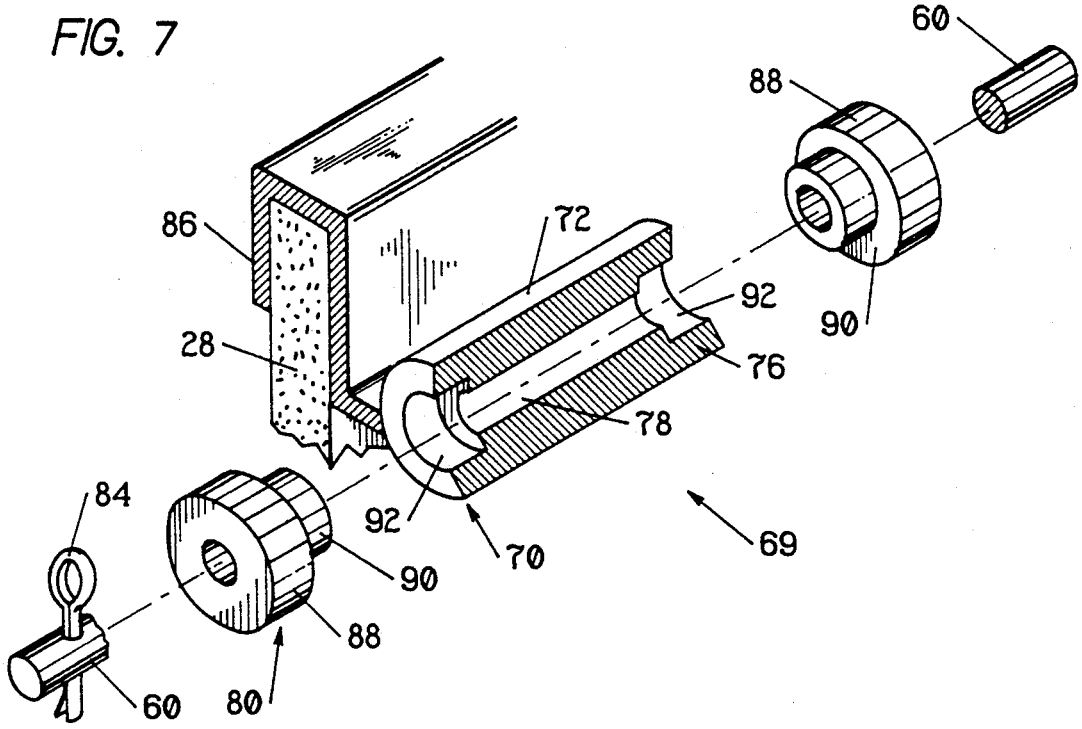
FIG. 7 shows a perspective view of a retainer assembly with counterbores in the ends of the main body of the retainer assembly.

Referring to FIG. 7, in a second embodiment each collar has a body 88 and a boss 90 and the main body 72 of the clasp section 70 has a counterbore 92 on each end. Once the rod or member 60 is received within the aperture 78 of the clasp section 70, the retaining collars 80, also with an aperture, are moved axially along the member, until the bosses of the collars are received by the counterbores of the main body 72. The collars thereby fix the member within the clasp section.

A pair of nuts 82 (FIG. 6A) secure the collars 80 to the main body 72 of the rod retainer assembly 69, one on each side. The nuts thread onto the threaded member 60. Alternatively, the collars may be secured to the main body by means such as cotter pins 84 (FIG. 6), washers, and spring clips or by other means.

The clasp section 70 attaches to a flange 86 fastened to the wall structure 28 by conventional means such as rivets (not shown). In another embodiment, the clasp section is molded to the wall structure.

Stiffening members may also be attached to the internal surfaces 68 of the wall panel structure in place of external stiffening members, or in combination with them. In a further embodiment, no stiffening assembly is used. The design of the hinge seams, in the further embodiment, is such that when the wall structure is unfolded, the wall structure rigidity is sufficient and requires no additional measures.

Although this invention has been shown and described with respect to detailed embodiments thereof, it will be understood by those skilled in the art that various changes in form and detail thereof may be made without departing from the spirit and scope of the claimed invention.

I claim:

1. A retainer assembly for an elevator cab, comprising:

a member;

a clasp section, having a main body disposed along an axis and a boss extending out from said body, parallel to said axis, said main body and said boss having an axially extending cutout and aperture, said aperture having a shape complimenting said member, wherein said cutout exposes said aperture, thereby allowing said member to pass through said cutout and be received by said complimentary aperture; and a collar, having an aperture, wherein said collar slides over said boss of said clasp section, thereby fixing said member within said aperture of said clasp section.

2. A retainer assembly according to claim 1, further comprising:

means for securing said collar to said main body of said clasp section, over said boss.

3. A retainer assembly according to claim 1, further comprising:

means for attaching said clasp section and said collar to the elevator cab.

4. A rod retaining assembly for retaining a rod to an elevator cab, comprising:

a clasp section, having a main body disposed along an axis and a boss extending out from said body parallel to said axis, said main body and said boss having an axially extending bore and cutout, wherein said cutout exposes said bore thereby allowing the rod to pass through said cutout and be received by said bore; and a collar, having a bore, wherein said collar slides along the rod and over said boss of said clasp section, thereby fixing the rod within the bore of the clasp section.

5. A rod retaining assembly according to claim 4, further comprising:

means for securing said collar to said main body of said clasp section, over said boss.

6. A rod retaining assembly according to claim 4, further comprising:

means for attaching said clasp section and said collar to the elevator cab.

7. A retainer assembly for an elevator cab, comprising:

a member;

a clasp section, having a main body disposed along an axis, said main body having a counterbored end and an axially extending cutout and bore, wherein said cutout exposes said bore thereby allowing said member to pass through to and be received by said bore; and a collar, having a body and a boss extending out from said body, and a bore axially extending through said body and boss, wherein said collar slides along said member, said counterbore receiving said boss, thereby fixing said member within said bore of said clasp section.

8. A retainer assembly according to claim 7, further comprising:

means for securing said collar to said main body of said clasp section, over said boss.

9. A retainer assembly according to claim 7, further comprising:

means for attaching said clasp section and said collar to the elevator cab.

10. A rod retaining assembly for retaining a rod to an elevator cab, comprising:

a clasp section, having a main body disposed along an axis, said main body having a counterbored end and an axially extending cutout and bore, wherein said cutout exposes said bore thereby allowing said member to pass through to and be received by said bore; and a collar, having a body and a boss extending out from said body, and a bore axially extending through said body and boss, wherein said collar slides along said member, said counterbore receiving said boss, thereby fixing said member within said bore of said clasp section.

11. A rod retaining assembly according to claim 10, further comprising:

means for securing said collar to said main body of said clasp section, over said boss.

12. A rod retaining assembly according to claim 10, further comprising:

means for attaching said clasp section and said collar to the elevator cab.

* * * * *